US010539321B2

(12) United States Patent
Ilin

(10) Patent No.: US 10,539,321 B2
(45) Date of Patent: Jan. 21, 2020

(54) PLASTIC HOT WATER BOILER

(71) Applicant: No Eul Kim, Busan (KR)

(72) Inventor: Andrey Pavlovich Ilin, Moskow (RU)

(73) Assignee: No Eul Kim, Busan (KR)

( * ) Notice: Subject to any disclaimer, the term of this patent is extended or adjusted under 35 U.S.C. 154(b) by 585 days.

(21) Appl. No.: 15/100,214

(22) PCT Filed: Nov. 29, 2013

(86) PCT No.: PCT/IB2013/003073
§ 371 (c)(1),
(2) Date: May 27, 2016

(87) PCT Pub. No.: WO2015/079279
PCT Pub. Date: Jun. 4, 2015

(65) Prior Publication Data

US 2017/0003016 A1 Jan. 5, 2017

(51) Int. Cl.
*F22B 1/30* (2006.01)
*F24H 1/20* (2006.01)

(52) U.S. Cl.
CPC ..... *F22B 1/30* (2013.01); *F24H 1/203* (2013.01); *F24H 2250/10* (2013.01)

(58) Field of Classification Search
CPC ..... F22B 1/30; F22B 1/303; F22B 1/306
USPC ..... 329/311, 323, 322, 337, 338, 336
See application file for complete search history.

(56) References Cited

U.S. PATENT DOCUMENTS 2,556,656 A * 6/1951 Lohman ..... F24H 1/106 392/326
3,743,780 A * 7/1973 Camp ..... A61H 33/12 128/203.27
3,775,589 A * 11/1973 Camp ..... F22B 1/30 239/136
3,854,454 A * 12/1974 Lazaridis ..... F24H 1/20 122/33
4,394,561 A 7/1983 Zerbel
4,423,310 A * 12/1983 Zerbel ..... F22B 1/30 338/83
4,637,347 A * 1/1987 Troy ..... F24D 3/082 122/15.1

(Continued)

FOREIGN PATENT DOCUMENTS

CA 1170698 A 7/1984
CN 1229465 A 9/1999

(Continued)

OTHER PUBLICATIONS

International Search Report dated Jul. 10, 2014 in corresponding International Application No. PCT/IB2013/003073; 3 pgs.

(Continued)

*Primary Examiner* — Dana Ross
*Assistant Examiner* — Ayub A Maye
(74) *Attorney, Agent, or Firm* — Maier & Maier, PLLC

(57) ABSTRACT

Combustion engineering, fluid heating, for example, water heating, using electricity to generate steam. The body of the device has of two identical halves—the upper and the lower. The material of the body is heat-resistant polymer containing one or more isotopes according to the general variant of body implementation. Each half of the body is made identical to the other half and has an elliptical cross-section.

10 Claims, 6 Drawing Sheets

(56) References Cited

U.S. PATENT DOCUMENTS

| | | | | |
|---|---|---|---|---|
| 4,874,104 | A * | 10/1989 | Klammer | F24H 1/181 220/4.21 |
| 6,263,156 | B1 * | 7/2001 | Ledoux | F22B 1/30 392/322 |
| 6,659,048 | B1 * | 12/2003 | DeSantis | F24H 1/18 122/13.3 |
| 8,094,998 | B2 * | 1/2012 | Rijskamp | F24H 9/1818 392/448 |
| 8,607,694 | B2 * | 12/2013 | Blanc | A47J 31/54 392/479 |
| 2007/0081801 | A1 | 4/2007 | Hendler et al. | |
| 2008/0139698 | A1 | 6/2008 | Nishida et al. | |
| 2009/0148729 | A1 | 6/2009 | Mills | |

FOREIGN PATENT DOCUMENTS

| | | | |
|---|---|---|---|
| CN | 2397431 | Y | 9/2000 |
| CN | 1675145 | A | 9/2005 |
| CN | 1714060 | A | 12/2005 |
| CN | 1732135 | A | 2/2006 |
| CN | 200973684 | Y | 11/2007 |
| CN | 201241100 | Y | 5/2009 |
| CN | 202109789 | U | 1/2012 |
| CN | 102604410 | A | 7/2012 |
| CN | 102776658 | A | 11/2012 |
| CN | 102911372 | A | 2/2013 |
| CZ | 9703589 | A3 | 6/1999 |
| DE | 102008028195 | B3 | 11/2009 |
| EP | 0268192 | A2 | 5/1988 |
| EP | 1937774 | A2 | 7/2008 |
| ES | 2128967 | A2 | 5/1999 |
| FR | 2818085 | A1 | 6/2002 |
| GB | 189824498 | A | 11/1899 |
| GB | 1 491 571 | | 11/1977 |
| GB | 1491571 | A | 11/1977 |
| GB | 2148468 | A | 5/1985 |
| JP | 60237034 | A | 11/1985 |
| JP | S60-237034 | A | 11/1985 |
| JP | 62-16175 | U | 1/1987 |
| JP | H01296042 | A | 11/1989 |
| JP | H02104789 | A | 4/1990 |
| JP | H04-13720 | A | 1/1992 |
| JP | H05-79321 | U | 10/1993 |
| JP | H11-245929 | A | 9/1999 |
| JP | 2000-074487 | A | 3/2000 |
| JP | 2001116366 | A | 4/2001 |
| JP | 2004-353930 | A | 12/2004 |
| JP | 2005-145861 | A | 6/2005 |
| JP | 2010040286 | A | 2/2010 |
| KR | 20050034065 | A | 4/2005 |
| KR | 20110033884 | A | 4/2011 |
| KR | 10-2011-0056538 | A | 5/2011 |
| KR | 101080650 | B1 | 11/2011 |
| KR | 10-2012-0052713 | A | 5/2012 |
| KR | 10-2012-0082531 | A | 7/2012 |
| KR | 10-1233750 | A | 7/2012 |
| RU | 2034852 | C2 | 5/1995 |
| RU | 2114126 | C1 | 6/1998 |
| RU | 2 133 924 | C1 | 7/1999 |
| RU | 2185961 | C1 | 7/2002 |
| RU | 2230760 | C2 | 6/2004 |
| RU | 2243966 | C1 | 1/2005 |
| RU | 2005134170 | A | 7/2006 |
| RU | 2447107 | C2 | 4/2012 |
| RU | 2492057 | C2 | 9/2013 |
| SU | 572444 | A1 | 9/1977 |
| TW | 200800793 | A | 1/2008 |
| WO | 98/04873 | A1 | 2/1998 |
| WO | 9804873 | A1 | 2/1998 |
| WO | 0020472 | A1 | 4/2000 |
| WO | 2004011400 | A1 | 2/2004 |
| WO | 2004046066 | A1 | 6/2004 |
| WO | 2004060831 | A1 | 7/2004 |
| WO | 2005054132 | A1 | 6/2005 |
| WO | 2006115569 | A2 | 11/2006 |
| WO | 2007035402 | A2 | 3/2007 |
| WO | 2011009589 | A2 | 1/2011 |

OTHER PUBLICATIONS

Decision to Grant dated Dec. 12, 2018 in corresponding Russian Application No. 2016117137/06(026910); 15 pages.

Korean Notice of Final Rejection (Final Office Action) dated Mar. 31, 2017, in connection with corresponding KR Application No. 10-2016-7008513 (7 pgs., including English translation).

Korean Notification of Reason for Refusal (Office Action) dated Sep. 30, 2016, in connection with corresponding KR Application No. 10-2016-7008513 (13 pgs., including English translation).

Korean Notification of Reason for Refusal (Office Action) dated Sep. 15, 2017, in connection with corresponding KR Application No. 10-2017-7015074 (13 pgs., including English translation).

Japanese Notification of Reasons for Refusal (Office Action) dated Jun. 20, 2017, in connection with corresponding JP Application No. 2016-535050 (9 pgs., including English translation).

European Supplementary Partial Search Report dated Nov. 13, 2017, in connection with corresponding EP Application No. 13898075.0 (11 pgs.).

Russian Official Action dated Jul. 20, 2018, in connection with corresponding RU Application No. 2016117137/06 (026910) (11 pgs., including English translation).

Australian Patent Examination Report No. 1 (Office Action) dated Nov. 2, 2016, in connection with corresponding AU Application No. 2013406429 (3 pgs.).

Canadian Requisition by the Examiner (Office Action) dated May 29, 2017, in connection with corresponding CA Application No. 2,931,944 (3 pgs.).

Canadian Requisition by the Examiner (Office Action) dated Jan. 11, 2018, in connection with corresponding CA Application No. 2,931,944 (3 pgs.).

* cited by examiner

PLASTIC HOT WATER BOILER

FIELD OF THE INVENTION

The invention relates to combustion engineering, fluid heating, for example, water heating, using electricity to generate steam. It can be used for a casing of any appliance intended to heat fluid and to generate steam. For example, the invention may be used in circulating water heating systems, self-regulating fluid heaters for autonomous heating and hot water systems, mobile heating units and hot water systems as an universal appliance for different electric heaters and steam generating units, including household ones.

BACKGROUND OF THE INVENTION

Fluid heating and steam generation using electric current is widespread in household use and in industry as well as in energy-generating plants. Nowadays, various types of heat-resistive plastics are used more and more frequently as housing materials for fluid heating devices. Such housing materials are used most often in household heating devices, for example, in hot water boilers, laundry washers, heating radiators, etc.

The following plastic materials are often used as casing materials:

TECAMAX SRP (PPP)—Polyparaphenylene;

TECATRON (TEKATPOH) (PPS)—Polyphenylene Sulfide. Trade names of other manufacturers—Fortron, REPRO (Japan), TECHTRON PPS (Belgium), Murdotec SP, Sustatron PPS;

Tecason E (PES)—Polyethersulfone. Trade names of other manufacturers—Radel A (Solvay), Ultrason E (BASF), Sustason®

PES; also WO2007035402 (A2)—2007 Mar. 29. Improved poly aryl ether ketone polymer blends—2006 January; RU2243966. Method for preparing aromatic sulfones—Jan. 9, 2003.

Tecason P (PPSU)/Polyphenylsulfone/Polyphenylene sulfone. Trade names of other manufacturers—Radel R (Solvay), PPSU 1000, Sustason PPSU.Tecason S (Tекacon C) (PSU, Polysulfone). Trade names of other manufacturers—Udel (Solvay), Ultrason S (BASF), PSU 1000, Sustason® PSU; EP1937774 (A2). Blends of poly aryl ether ketones and polyetherimide sulfones—2008 Jul. 2.

Tecapei (PEI)/Polyetheramide Trade names of other manufacturers—Zedex-410, Susta® PEI, PEI 1000, Ultem®.

POLYAMIDES are the cheapest materials:

HS BLUE temperature-stabilized CAPROLONE cast nylon 6 HS (Nylacast);

Caprolon/TECAST T (PA 6 G)/Cast 6-block polyamide. Trade names of other manufacturers—Ertalon 6 PLA, Nylon, Caproloktam, Sustamid 6G®, Ultralon (Caproloktan, Polycaproamide, Capron, Caprolon).

Below Table Sums Up the Properties of the Above-Mentioned Polymers

| Material | Permanent operating temperature ° C. | Short-term operating temperature ° C. | Dimensional stability temperature (HDT/A technique) ° C. | Thermal expansion factor ($10^{-6}$ 1/K) (ASTM D 696, DIN 53 483, IE-250) | Bulk resistance $10^{15}\Omega$*cm (ASTM D 257, EC 93, DIN IEC 60093) |
|---|---|---|---|---|---|
| TECAMAX SRP (PPP) | +140 | +150 | +152 | 30-40 | 6 |
| TECATRON PPS | +230 | +260 | +110 | 50 | 0.01 |
| Tecason E (PES) | +180 | +220 | +204 | 55 | 10 |
| Tecason P (PPSU) | +170 | +190 | +207 | 56 | 10 |
| Tecason S (PSU) | +160 | +180 | +169 | 55 | 10 |
| Tecapei (PEI) | +170 | +200 | +180 | 50 | 1 |
| TECAST T (PA 6 G) | −40 up to +100-115 | +170 | +95 | 75-95 | 0.1 |

Filling agents (RU2447107—2007, 24 Sep. 9; CN102776658 (A)—2012 Nov. 14; CN102604410 (A)—2012 Jul. 25; DE102008028195 (B3)—2009 Nov. 26; JP2010040286 (A)—2010 Feb. 18; US2008139698 (A1)—2008 Jun. 12; KR101080650 (B1)—2011 Nov. 8) or laminating materials (RU2492057 C2 29 Oct. 2008—Method of making polycarbonate laminate composite) are often use to modify and preset plastic properties, which provide their high thermal stability, dimensional stability under heat, required mechanical and electric parameters.

However, low homogeneity is the general shortage of such housing materials; it does not provide required operating reliability for water heater cases. It may be explained by severe operating conditions with considerable temperature and pressure drops both in static and dynamic modes, complicated convection processes. These factors in their combination create additional conditions for failure of heater casings manufactured from non-homogeneous material. The same factors significantly decrease operating life and increase their cost since additional special activities should be taken to decrease the effect caused by casing heterogeneity. Besides, material heterogeneity decreases functional capabilities of appliances and their generality since presetting range of material properties becomes confined.

It is known that rare-earth elements are doped into plastics as well as their oxides, for example, sulphates, borides, alkyls, silicides, halides and rare-earth metals and their mixtures (WO2005054132 (A1) Tagged polymeric materials and methods for their preparation—2005 Jun. 16; WO0020472 (A1). Catalyst and methods for polymerizing cycloolefins—2000 Apr. 13). US2009148729 (A1) Inorganic-hydrogen-polymer and hydrogen-polymer compounds and applications thereof—2009 Jun. 11—is known, which is inorganic polymer with increased hydrogen energy.

However, these materials feature by the following disadvantages: high cost and complexity of the material fabricated using such manufacturing processes; manufacturing complexity, its sensitivity to contaminants; overexposure to the accuracy of polymerization conditions; the need in expensive catalysts, etc. In addition, application of such functionalized materials as well as their manufacturing techniques is unknown at the existing level of science and technology in water heating appliances and other devices used liquid of gaseous heat carrier. Besides, casings of such devices operate in permanent rigid thermal and convection modes resulting in toxicity facilitation for such materials and restriction of their use in household appliances and industrial food-processing plants.

Isotope introduction (mainly, deuterium) in plastics is known, for example, SU572444 (A1). Method for preparation of halogenolefins labelled by deuterium—1977 Sep. 15; EP0268192 (A2) Esters of (meth) acrylic acid—1988 May 25; JPS60237034 (A) Aromatic compound containing deuterium and its preparation—1985 Nov. 25—deuterid of styren. RU2005134170 A—Highly pure 3,3-diphenylpropylamino monoesters—Mar. 4, 2004; WO2004011400 (A1). Method of deuterating aromatic ring—2004 Feb. 5; WO2004046066 (A1). Method for deuteration or tritiation of heterocyclic ring—2004 Jun. 3; WO2004060831 (A1). Method of deuterization—2004 Jul. 22.

This method allows achieving variability of physical and mechanical properties at maximum polymer homogeneity. This significantly increases resistance of such materials to changing thermal and mechanical loads as well as improves coordination of properties with other materials. In addition, application of non-toxic isotopes with low content results in high biocompatibility.

Nevertheless, current scientific and technological state-of-art does not have the data concerning introduction of other isotopes, apart from deuterium, into polymeric materials used for manufacturing case of water boiler and steam-generating facilities.

The known appliance desings may be related to several groups.

The first group. Plastic casing with arbitrary geometry, which is used for direct-flow water heaters. This group includes, for example, the following appliances:

a) Devices, in which heating elements contact with the whole heat carrier being within the casing at the given moment: CZ9703589 (A3). Direct-heating electric electrode boiler—1999 Jun. 16—preferably, electrodes are located horizontally along the plastic housing at the vertices of regular hexagon or star and are connected by delta; WO2011009589 (A2). Electrode boiler—2011 Jan. 27—built-in PTFE cylindrical thick-walled housing manufactured as a bushing with side inlet and butt outlet of liquid heat carrier; it contains ionization chamber and ionizing bar.

b) Devices, in which heating elements contact with the part of the heat carrier being within the casing at the given moment: KR20110033884 (A). Induction plastic water heater—2011 Apr. 1—plastic housing of a dirrect-flow induction water heater manufactured as a rectangular block with jacketed walls, in which heat carrier flows. This design aims to improve thermal efficiency, useability and to minimize manufacturing costs;

c) Asymmetric plastic case with the simplest shape US2007081801. Plastic boiler without flange (A1)—2007 Apr. 12—A boiler intended for running fluid heating; it comprises a plastic case and a heating element, which passes through a fixing hole in the boiler case at its inner side and is fastened into the mounting hole. The heater has warming sections located at least in the mounting hole area. Diameter, at least, of the part of the mounting hole is equal to the heater outer diameter. FR2818085 (A1). Heating installation esp for viscous products comprises insulated pipe divided into sections by rotary disc electrodes linked to power supply—2002 Jun. 14—is a plastic casing made as a flow-through pipe divided into sections by rotating disc-shaped electrodes. JPH01296042 (A). Booster heater device for cogeneration system—1989 Nov. 29—is a plastic case as a flow-through pipe with electrodes made as parts of the inner pipe surface;

The second group. Storage water heaters, steam generators.

a) CN200973684 (Y) Omnipotence type cleaner—2007 Nov. 14—is a steam cleaner with several cleaning functions and a case manufactured from high-grade plastic;

b) ES2128967 (A2) Evaporator—1999 May 16—has a case and a cap fabricated from plastic. The cap has a side casing for hidden electric switch of evaporator. Evaporator is formed by two adjacent metallic sheets, which are sunk into a water tank from the evaporator The third group. Plastic electrodes.

a) WO2006115569 (A2). Instant water heater with PTC plastic conductive electrodes—2006 Nov. 2—is an instantaneous water heater that applies positive temperature factor of plastic electrically-conducting structures used for electrode material. Water is heated by heat emission due to water electric resistance by electric current between electrodes. Electrode material is exposed by phase conversion at certain temperature and becomes non-conducting at preset temperature. Electrode material with positive temperature factor decreases or stops itself water heating upon attaining required water temperature;

b) Application of nanoscale materials—TW200800793 (A). Flexible nano electrothermal material and heating apparatus having the same—2008 Jan. 1. This invention relates as a whole to flexible nanoscale electrothermal material intended for heating device. Flexible nanoscale electrothermal materials comprise the carrying base with certain number of carbon nanotubes dispersed in template. Carbon nanotubes form conducting mesh in template;

The forth group. Appliances with symmetric plastic cases.

a) with symmetric case design U.S. Pat. No. 4,394,561 (A) Tank structure for an air humidifying electrode steam generator—1983 Jul. 19—Steam generator with electrodes that comprises tubular water reservoir, upper and lower halves. They are moulded from electric-insulating plastic as mirror reflections in such a way that may be formed from the matrix of the same design; CA1170698 (A1). Electrical steam generator for air humidifier—1984 Jul. 10.

The fifth group. Use of appliances with elliptic shape.

a) Housing. GB189824498. Improved Apparatus for Evaporating Water or other Liquids by Means of Steam (A)—1899 Nov. 18—longitudinal housing cross section is a cylinder with two coupled hemispheres at butt ends;

CN2397431 Environmental protection energy-saving atmospheric hot-water boiler with nonmetal electric heating plate (Y)—2000 Sep. 20;

b) Elliptic pipe cross-section—CN202109789 (U) Heat exchange device using elliptic spiral heat exchange pipes—2012 Jan. 11; GB2148468 (A). A boiler having heat transfer tubes of elliptical cross-section—1985 May 30—pipes with elliptic cross section;

c) Pipes.—CN201241100 (Y). Radiation section boiler tube of hydrocarbons steam cracking furnace—2009 May 20; Pipe configuration is elliptic or close to ellipse;

d) Case and pipes at the same time: JPH02104789 (A). Spray combustor for black liquor and combustion boiler therefor using the same—1990 Apr. 17; KR20050034065 (A). Elliptic heat exchanger for dual-type gas-boiler—2005 Apr. 14.

However, combination of lateral and longitudinal cross section in boiler casing is not found and is not explicit from current level of science and technology, especially in combination of such configuration with plastic case and, moreover, containing isotopes. At the same time, it is the combination allows solving assigned task and, hence, has significant distinctive features.

BRIEF SUMMARY OF THE INVENTION CONCEPT

The object of invention is to improve processability and simplicity while manufacturing casings for water-heating appliances. Simplicity and processability improvement also comprises the possibility to decrease requirements to the materials used for their cases. The object also includes homogeneity increase of the casing materials being used; improvement of thermal, mechanical and electric properties of boiler casings as well as the best combination of their properties with corresponding parameters of metallic components used with plastic casings. The object also claims improvement of reliability and long service life (elliptic case, minimum of split-design parts and ones passing through a case, minimum number of through holes) of an appliance, its protection against improper assembly, less strict requirements to assembly accuracy. The object also claims improvement of operating performance of an appliance (case shape, options for its fastening), its service life, service life of plastic case, increase of the device repairability (split case design, replaceable electrodes, disconnectable outlets). Besides, the invention solves the problem of expanding functional capabilities, versatility and flexibility of the device application, extension of possible product range and increase of adaptability to solve specific problems, the ability to vary the case physical properties without changing its design.

To solve the problems, the plastic hot water boiler contains the body made of heat-resistant plastic; and the composition of plastic of the body includes stable isotopes of the elements composing the plastic. Furthermore, deuterium is used as the isotope included in the plastic structure.

The plastic hot water boiler, wherein as the isotope included in the plastic structure $^{13}C$ is used.

The plastic hot water boiler, wherein as the isotope included in the plastic structure $^{14}C$ is used.

The plastic hot water boiler, wherein as the isotope included in the plastic structure $^{17}O$ is used.

The plastic hot water boiler, wherein as the isotope included in the plastic structure $^{18}O$ is used.

The plastic hot water boiler, wherein as the isotope included in the plastic structure $^{15}N$ is used.

The plastic hot water boiler, wherein as the isotope included in the plastic structure $^{33}S$ is used.

The plastic hot water boiler, wherein as the isotope included in the plastic structure $^{34}S$ is used.

The plastic hot water boiler, wherein as the isotope included in the plastic structure is used the mix of isotopes D, $^{13}C$, $^{14}C$, $^{17}O$, $^{18}O$, $^{15}N$, $^{33}S$, $^{34}S$ in any combinations.

The plastic hot water boiler containing:

a) at least two electrodes mounted inside the body;

b) each electrode comprises an electric lead;

c) the electric lead is located on one end of each electrode, and electric leads of electrodes are placed outside of the body; and electrodes along with leads are replaceable;

and connection of the electrode with electrical lead is detachable, and each electrode is configured with possibility of connection to it of the electric lead at any end of the electrode.

The plastic hot water boiler, where the body has a) at least one opening to fill the boiler;

b) at least one lid covering the filler opening of the boiler.

The plastic hot water boiler, where the body:

a) is made in the form of two detachable halves;

b) the halves of the body are identical.

The plastic hot water boiler, where the body has through inlet and outlet nozzles.

The plastic hot water boiler, wherein:

a) the inlet nozzle is made on the first body half;

b) the outlet nozzle is made on the second body half;

c) nozzle connections with the first and the second body halves are made identical.

The plastic hot water boiler, wherein:

a) electrode mountings are made in different body halves;

b) electrode mountings are made identical in different housing halves.

The plastic hot water boiler, wherein the body has the form close to elliptical in the cross-section.

The plastic hot water boiler, wherein the body has the elliptical form in the cross-section.

The plastic hot water boiler, wherein the body has close to the elliptical form in the longitudinal section.

The plastic hot water boiler, wherein the body has the elliptical form in the longitudinal section.

The plastic hot water boiler, wherein the body is made of plastic with the largest possible coefficient of thermal expansion close to the coefficient of thermal expansion of electrodes.

The plastic hot water boiler, wherein the body halves are joined with adhesive bonding.

The plastic hot water boiler, wherein the body halves are joined with sealant.

The plastic hot water boiler, where the body halves are welded.

The plastic hot water boiler, wherein the body halves are joined with bolted connection, and the hot water boiler comprises an elastic sealing gasket disposed between the two body halves.

The plastic hot water boiler, wherein the body is made in the form of ellipse in the cross-section with removed segment The plastic hot water boiler, wherein the body contains additional cover plate, which:

a) is made in the form of parallelepiped;

b) is located outside of the body;

c) one facet of the cover plate adjacent to the body has curved form corresponding to the shape of the outer part of the body to which it is connected;

d) one facet of the cover plate opposite to the facet, adjacent to the body, is flat;

e) the cover plate contains holes made from the side of the flat facet, opposite to the curved facet.

The plastic hot water boiler containing at least two protective housings of electrodes, each of them comprises the housing body, at least one fastening element to the boiler body, holes for fastening elements, an outlet opening for wires, provided with a protective nozzle, and:

a) each housing is located on corresponding half of the boiler body over the outer electric leads of electrodes;

b) the fastening element of housing is connected to it and to the boiler body;

c) housings, fastening elements to the body of the boiler are identical for the two halves of the boiler body;

d) the housings are integral with plastic nozzles.

BRIEF DESCRIPTION OF DRAWINGS

FIG. 1 shows the scheme of the longitudinal section of the device body on the variant 1 for the case of two electrodes.

FIG. 2-5 schematically show the cross section view of the body on the variant 1 for different sub-variants.

FIG. 6-15 schematically show the longitudinal section (FIG. 6, 11) and the cross sections of the device on the variant 2 with electrodes located on one side of inlet and outlet nozzles.

FIG. 16 schematically shows the longitudinal section and the cross sections (FIG. 17-19) of the device on the variant 3 with location of electrodes on both sides of the inlet and outlet nozzles.

FIG. 20-29 show more detailed specification of the device on the variant 4.

DESCRIPTION OF THE PREFERRED VARIANTS OF THE INVENTION IMPLEMENTATION

Figure 1:
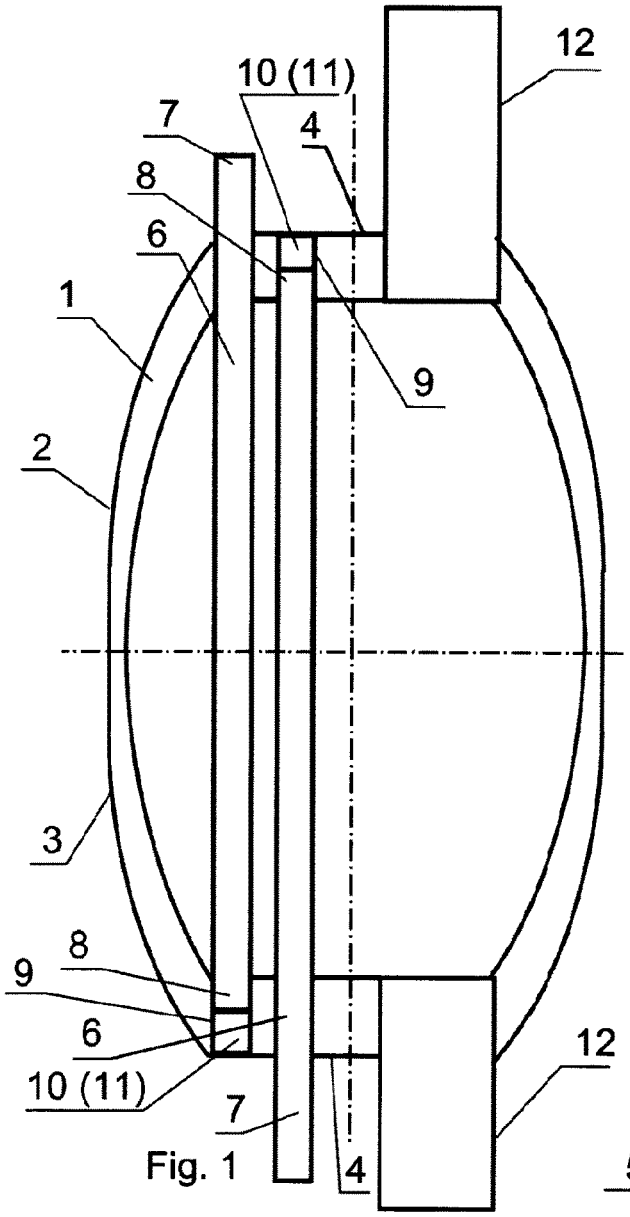
FIG. 1-29 show the scheme of general variant of the device body on the proposed invention, for all variants of the device construction implementation.
Figure 3:
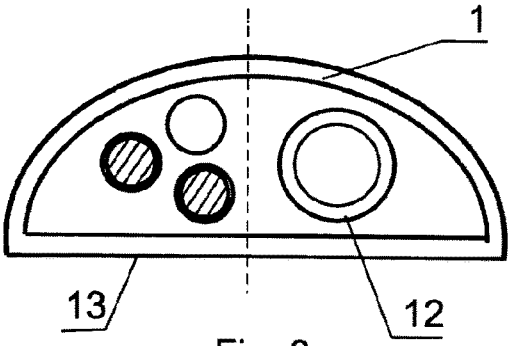

General Variant of the Device Body.

FIG. 1-26 show the performance of the body material for all structural variants of the device.

According to the general variant of the body 1 performance of the plastic hot water boiler on the proposed invention, its material contains isotopes of the elements included in the plastic structure. The most common is the deuterium. Isotopes of other elements included in the plastic may be also used. These include $^{13}C$, $^{14}C$, $^{17}O$, $^{18}O$, $^{15}N$, $^{33}S$, $^{34}S$, depending on the specific type of used heat-resistant plastic. Moreover, one of these isotopes or their mix in any combination can be used. The content of listed isotopes and their variation can provide programmable variation of physical properties of the body material that enables the best way of their selection according to the device destination, and in compliance with its individual elements. Thus change in the isotopic composition can increase temperature of the glass transition point of the body polymer 1 (EP0268192 (A2)—1988 May 25).

It also allows modifying, as necessary, electrical properties of the body 1, for example, to increase superficial and volumetric electric resistivity, dielectric breakdown strength of the body [1]. Also, the proposed technical solution allows to change directionally the coefficient of linear and volumetric thermal expansion, which is very important for the best match to the thermal expansion coefficients of other elements of the device, in particular, of metallic components. Although the individual change in the plastics properties with variation of the isotopic composition is known (EP0268192 (A2) Esters of (meth) acrylic acid—1988 May 25, [1]), its usage in the field of fluids thermal heating, including in the construction of bodies of water-heating devices in all variants is unknown on the level of the prior development of science and technology, and the combined entry and changes in concentration of the proposed isotopic composition also are unknown. It enables the appearance of new quality properties of hot water boiler bodies, significantly increases their reliability of both static and dynamic modes and improves durability, wear-resistance and reduces the operating cost. Technique and technology of isotopes injection in polymers is known and mastered, in particular, of deuterium (JPS60237034 (A)—1985Nov. 25; RU2114126—1998 Jun. 27; US2009148729 (A1)—2009 Jun. 11; CN102911372 (A) Benzo crown ether graft polymer material with lithium isotope separation effect and preparation method thereof—2013 Feb. 6) as well as the introduction of rare earths elements and their oxides (WO2005054132 (A1)—2005 Jun. 16). However, it is not known from the preceding development of technology used in bodies of hot water boilers and it is significant difference from the preceding devices. The proposed implementation of bodies, unlike the use of fillers in their materials, allows keeping high uniformity of the body, experiencing significant static and dynamic thermal loads. It increases the resistance to these loads with respect to existing materials containing fillers and other alien additives to body material. Also, when using the proposed implementation of bodies for materials containing fillers (RU2230760. Hydrophobic-nature polymers filled with starch complexes—1999 Sep. 22; RU2034852. Filled polymer production method—1990 Jul. 27; for example polymers of glass filled—RU2185961. Plant for production of filled plastics, mainly, fiber-reinforced material—2001 Mar. 28), it is also performed possibility of finer programming of physical properties without affecting the applied degree of uniformity of the body material.

In addition, in all cases the concentration of isotopes in body plastic can start with the lowest possible value, which allows using materials for bodies manufacturing without special forced polymers refining from natural isotopes contained therein. This allows to raise substantially the simplicity and processibility of the device bodies, and to reduce their production costs.

Variant 1.

According to the variant 1 the body (1) of device consists of two identical halves—the upper (2) and the lower (3) (FIG. 1). The material of the body (1) is heat-resistant polymer containing one or more isotopes according to the general variant of body implementation. Each half of the body (1) is made identical to the other half and has an elliptical cross-section (FIG. 2-5). Such implementation of two halves as unified single detail significantly simplifies the technology of the device fabrication, as it allows using one snap for both halves and for different designs. However one half of the body may contain intentionally redundant elements, such as openings (5) for electrodes (6), which are used in some variants of the device are not used in other variants (FIG. 2-6). Or these redundant elements (e.g., openings (5)) are used in one half of one variant and are not used in the other half of the body of the same variant. It also increases the body (1) unification, and therefore it simplifies technology of the device manufacturing. Such technical solution in combination with the content of indicated isotopes in the stated order is unknown from the preceding development of technology and in combination it creates the super effect not reducible to a simple sum of the effects of entering each feature separately.

Figure 28:
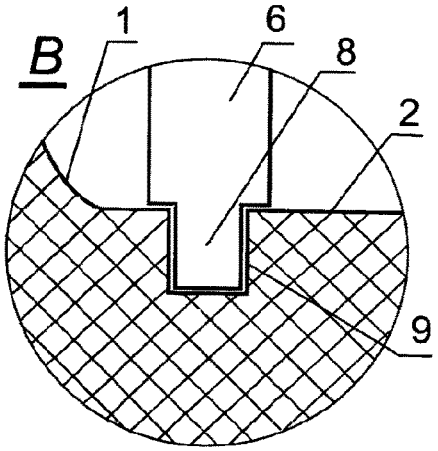
Figure 26:
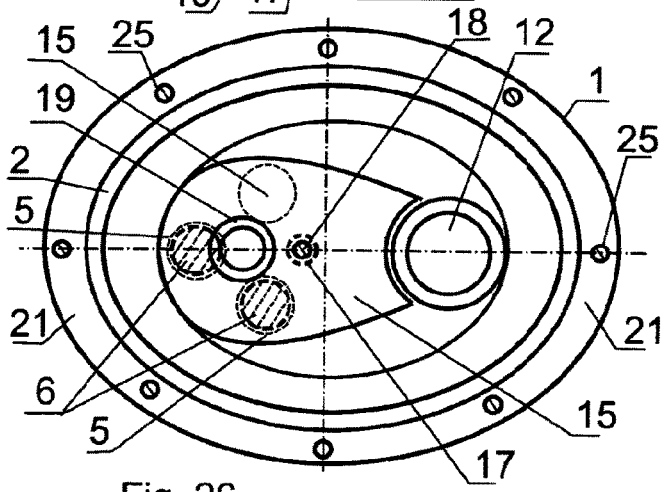
Figure 29:
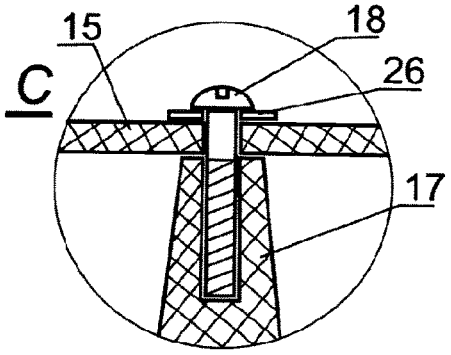

The longitudinal section of the body (1) is also made close to elliptical with truncated tops (4) at the poles of the major axis to increase processibility of the device and to simplify assembly. Furthermore, execution of the body (1) in elliptic or close to elliptic form in the longitudinal and transversal sections improves operating conditions by enhancing compactness with simultaneous improvement of the heat-transfer agent convection conditions inside the body (1). The surfaces of poles (top and bottom facets of the body according to drawings) (4) contain through openings (5), into which the metal electrodes (6) are installed in the event of the electrode boiler. Any electric heaters also can be installed in these openings. For this variant, in the case of the electrode boiler, two electrodes are used, and each of the electrodes (6) contains one electric lead (7) connected to the one end of the electrode. Thus, the electrodes (6) are located predominantly in the interior of the body (1) opposite to each other. The second free end (8) of each electrode is inserted into the free opening (5) of the end (4) of each of the halves (2) and (3) of the body (1). The free space (9) may be filled with a compound, sealant or closed with a plug (10) (FIG. 1). Also it is possible sealing of the end (8) of the electrode (6) as a spline in the inner surface of the body (1), made in the form of a recession (11) (FIG. 28). It allows to prevent curving of electrodes (6), while the boiler is working under the influence of thermal and mechanical loads, and to eliminate completely the possibility of their short-circuiting. In turn, it significantly increases reliability of the device, compared to the known, and enables its usage with considerable mechanical perturbations, including permanent, such as shaking, acceleration, vibration, etc. It also extends the device functionality and increases its versatility, as it provides smooth operation in a mobile version directly on the move.

Figure 4:
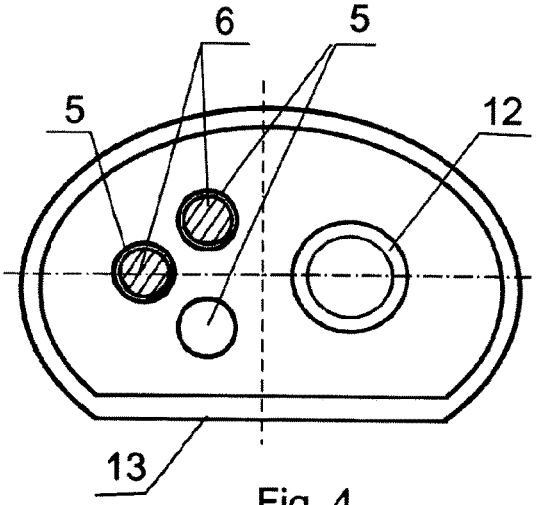
Figure 2:
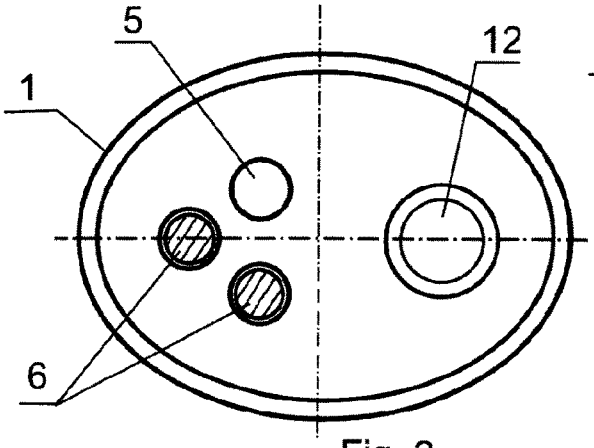
Figure 5:
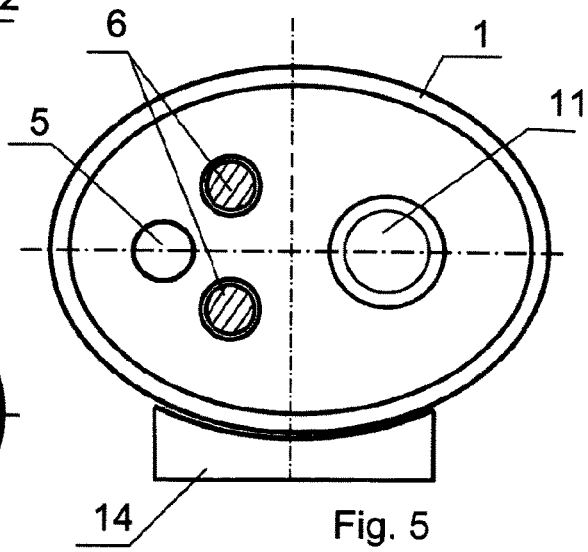
Figure 6:
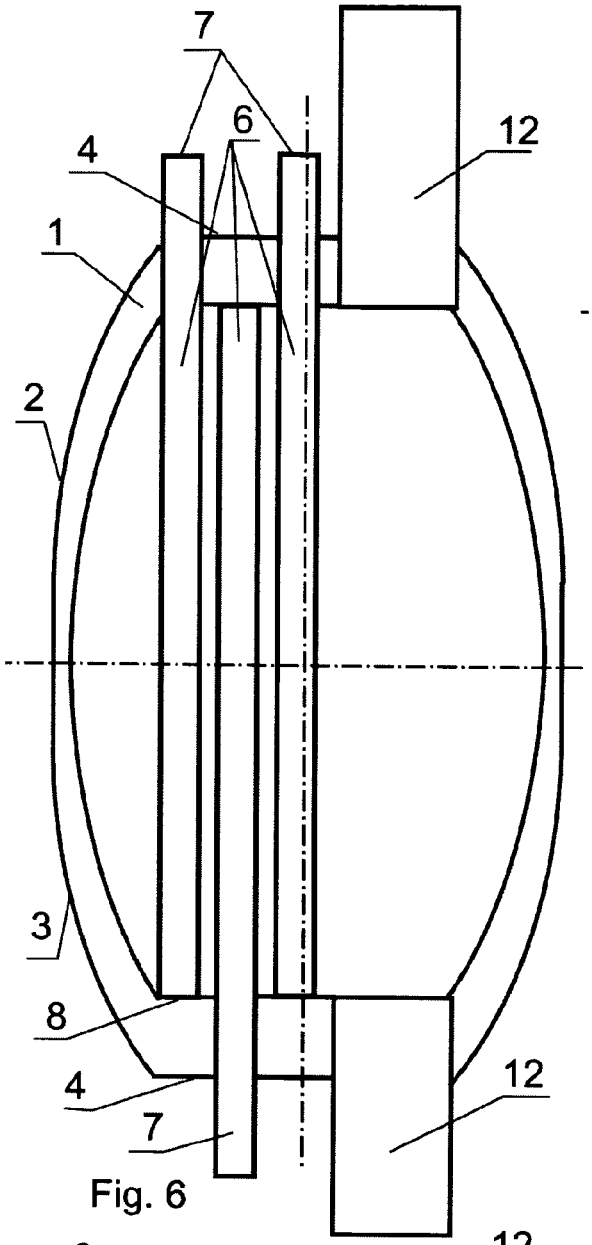
Figure 8:
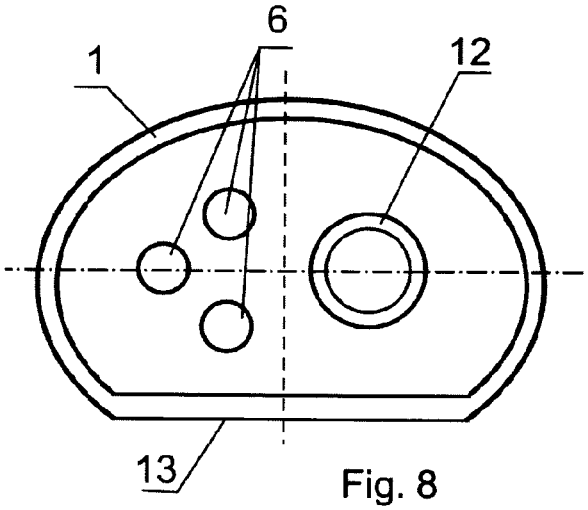
Figure 9:
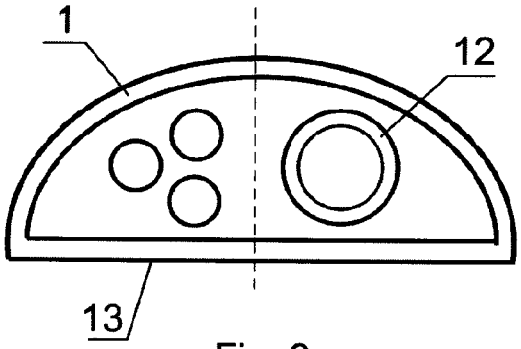
Figure 7:
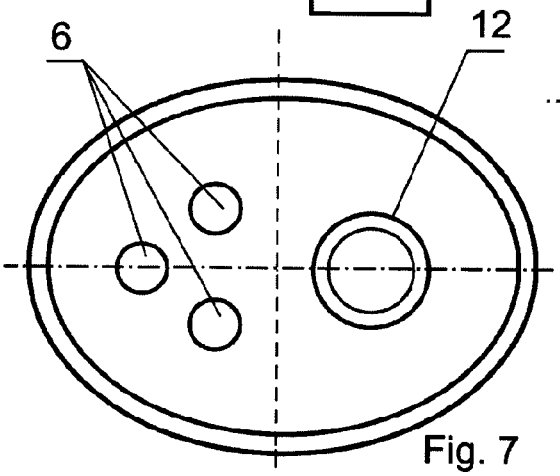
Figure 10:
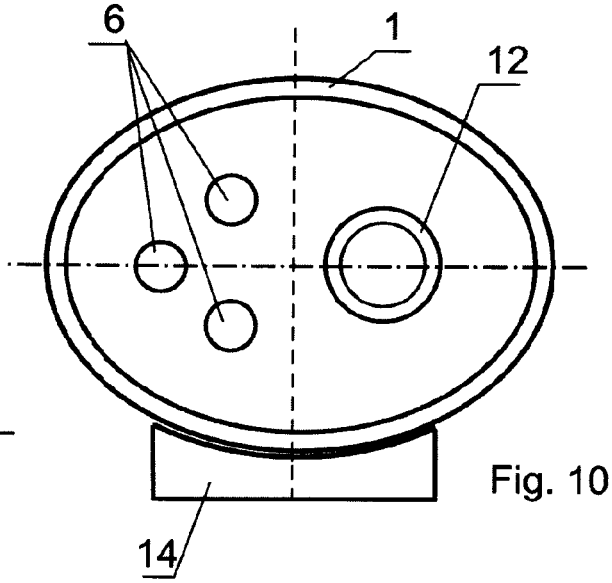
Figure 11:
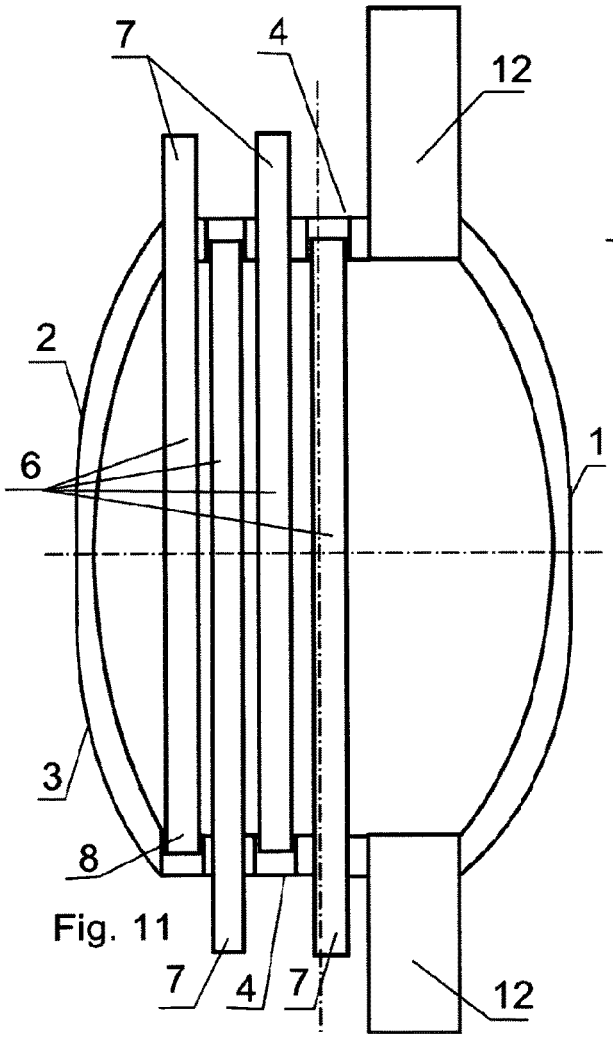
Figure 13:
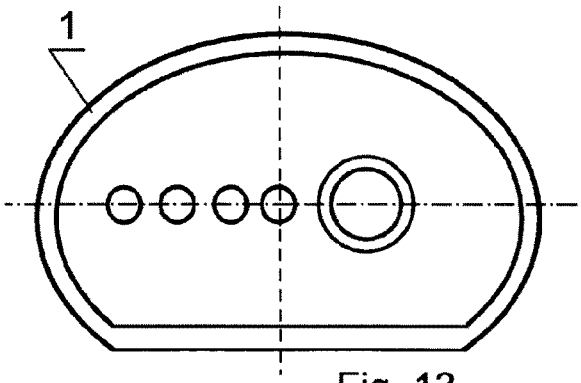
Figure 14:
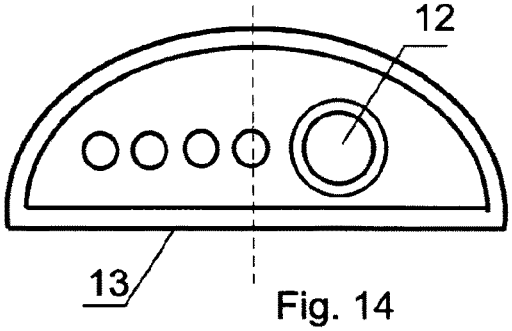
Figure 12:
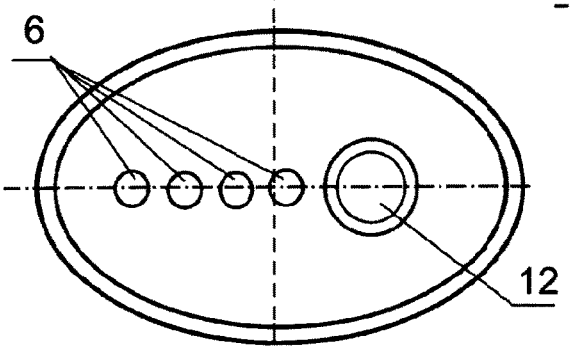
Figure 15:
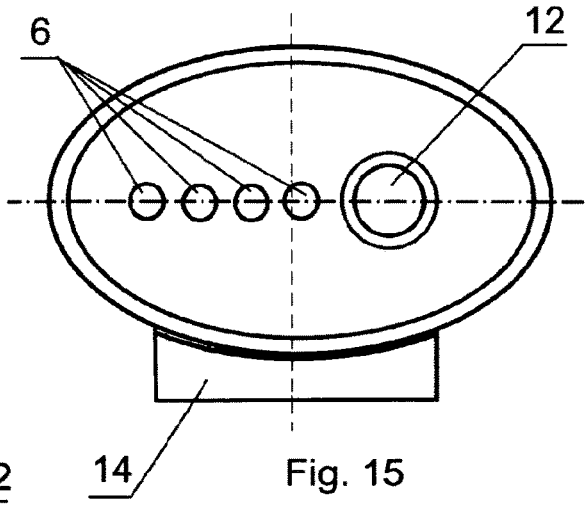
Figure 16:
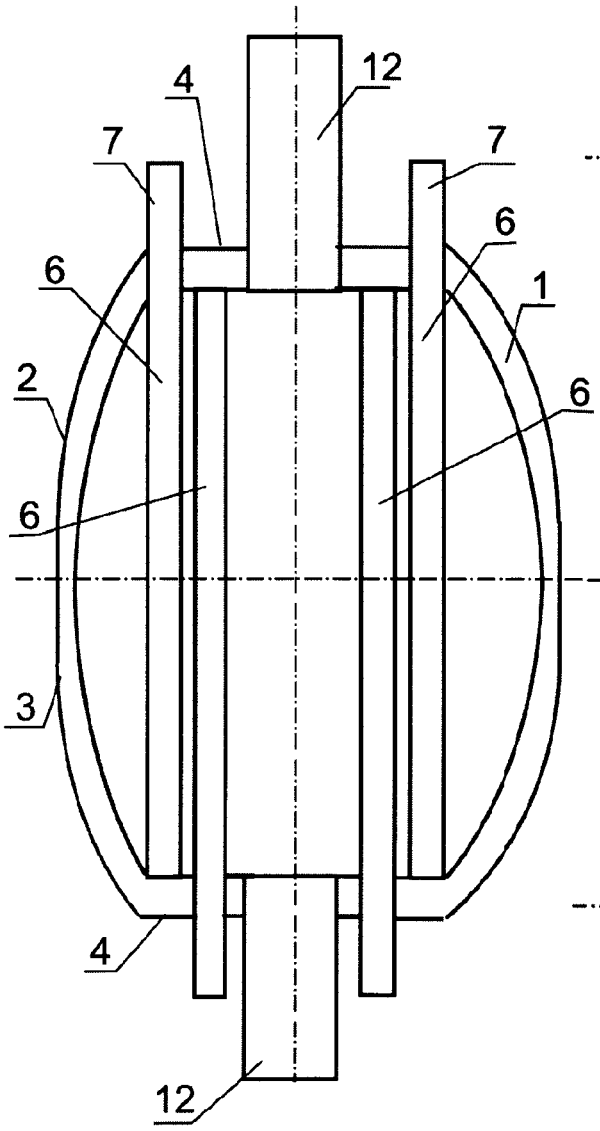
Figure 18:
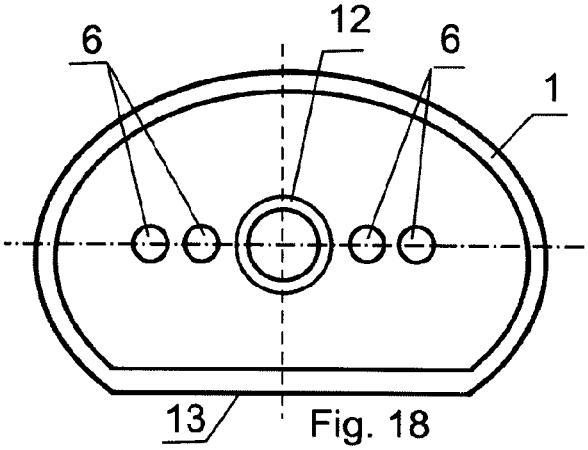
Figure 17:
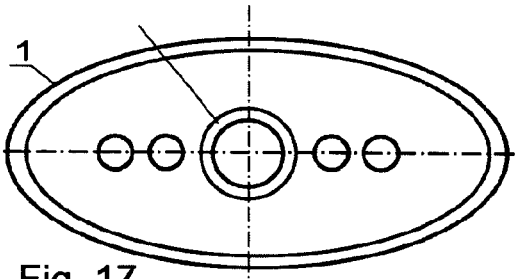
Figure 19:
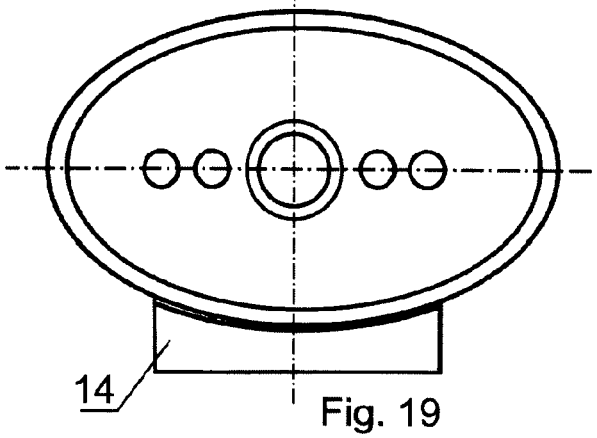

Each half (2), (3) of the body (1) contains the nozzle (12), which is made identical and is fixed in the same place at the end (4) of the body (1) and can be both an input, and output in the case of in-line heater. It also raises unification of the device. The body (1) may have one flat facet (13) to enhance serviceability and reliability of the device mounting on a flat surface such as on a wall. And the flat facet (13) can pass through the symmetry axis of the elliptical cross section of the body (1) (FIG. 3) and may not pass through it (FIG. 4).

As sub-option, the device body (1) may be formed as a whole not truncated ellipse in cross section, and may further comprise a support (14) (FIG. 5) to improve performance and reliability of the device mounting on a flat surface, such as a wall. However the support (14) is made in the shape of parallelepiped, one its bigger side is flat and is used for mounting. The second big side of the support (14) repeats the utmost the outer surface of the body (1) and is connected to it.

Variant 2

In the device on the variant 2 (FIG. 6-15) it is used the body (1) consisting of two contra-lateral identical halves (2) and (3), whose plastic material contains one or more isotopes according to the general variant of the device implementation. Its specifics are the use of a larger number of electrodes (6) than two in combination with the body material on the general variant of device performance. This allows to improve thermo-resistant and insulating properties of the body and to increase the number of electrodes more than two, using a sufficiently narrow body (1), which expands functionality of the device, increases its reliability and energy efficiency, as it allows the use the three-phase network, as well as enables the use of redundant backup auxiliary electrodes (6). Herewith the number of electrodes (6) may be either odd, e.g. for three-phase network (FIG. 6-10) or even (FIG. 11-15). In the case of in-line implementation of the device, it comprises the inlet and outlet nozzles (12), located identically on each half (2) and (3) of the body (1). However the electrodes (6) are located on one side of nozzles (12) and may be located on the same longitudinal axis, or may be shifted relatively to it, depending on needs and parameters of heat exchange. Also the configuration of electrodes on the surface of the upper and lower facets (4) of the body (1) may be any (FIG. 6-15). Sealing of the loose ends (8) of electrodes 6 can be performed similarly to variant 1.

Variant 3.

FIG. 16-19 show the view of the plastic hot water boiler configuration according to the variant 3 of the present invention implementation. The variant 3 includes signs of the general variant of the device implementation and relatively to the options 1 and 2 has the following particularities.

According to the variant 3, nozzles (12) for in-line boiler implementation are located along the central longitudinal axis of symmetry or close to it, and electrodes (6) of the device are located on both sides of nozzles (12). The number of electrodes (6) depends on specific destination of the device, and can vary from two or more. Also their number can be both even and odd. Location of electrodes inside the body 6 relatively to the orientation of their electrical leads (7) may be counter (FIG. 16), unidirectional or combined. It allows accommodating the device to the different variations of technological processes of its manufacturing. The proposed implementation in combination with composition of the body material used according to the proposed invention allows maximizing mechanical strength of the body, including increased resistance to internal pressure and consequently allows increasing reliability of the device.

Variant 4

Figure 24:
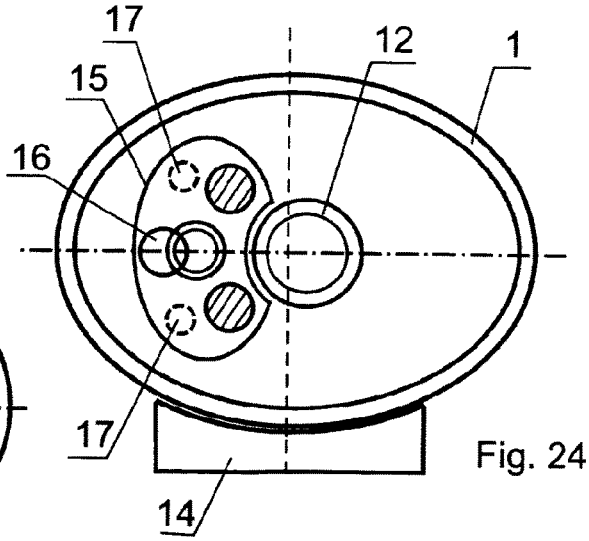
Figure 21:
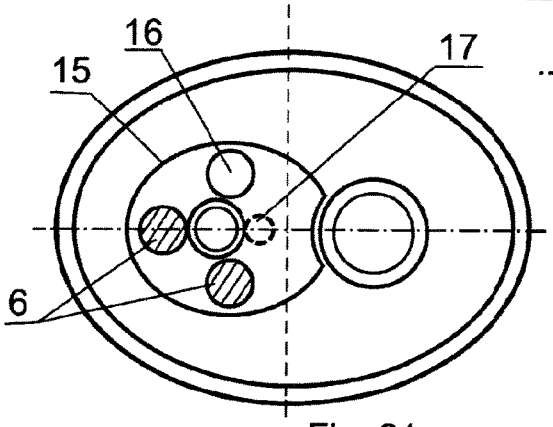
Figure 25:
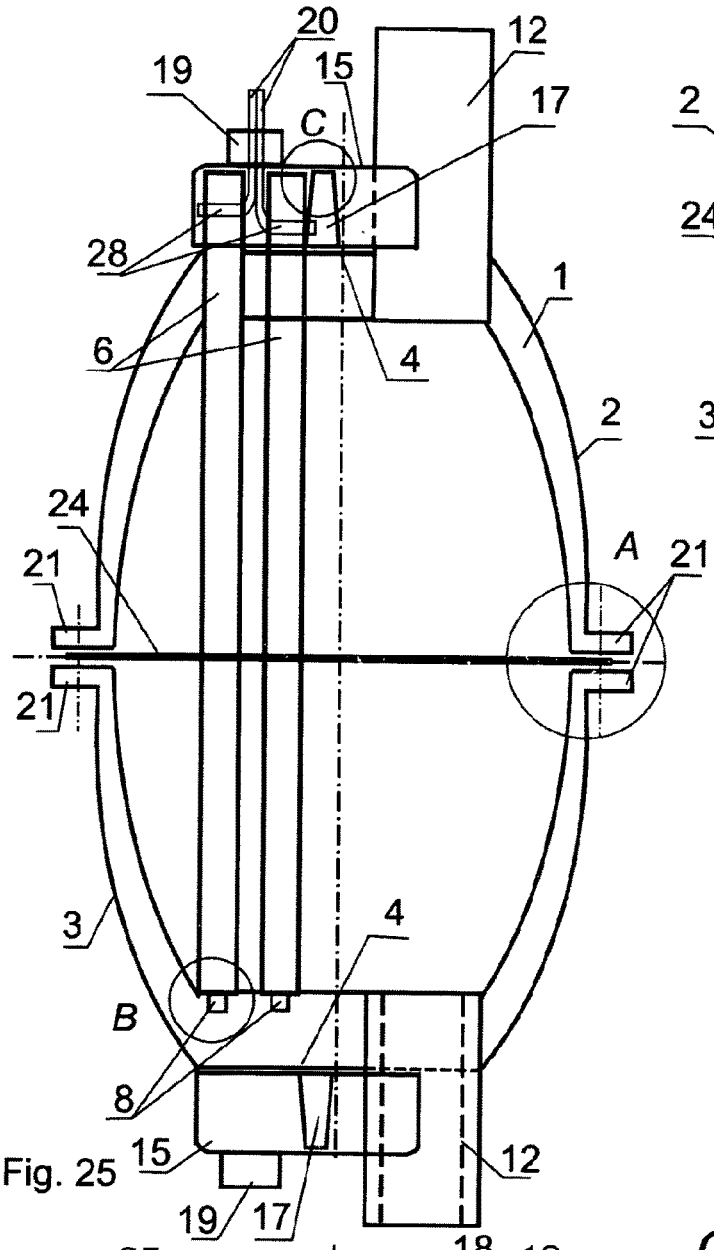

The variant 4 of the device implementation can be further implemented in each previous variant. According to this variant, the caps (15) are installed on the upper and the lower facets (4) of the body (1); the lower part of caps is open. Caps (15) are mounted over the leads of the electrodes (7), so that they completely cover them, including unused openings (16), if any. In case the electrodes are located on both sides of the nozzles, on each upper and lower facet (4) of the body (1) two caps (15) can be used, each cup covers one group of electrodes (6) located on one side of the fitting (12). Each cap (15) is fixed to the upper or lower facet (4) of the body (1) via at least one rack (17), formed as a boss on each of the facets (4). Number of racks (17) may be more than one per one cap (15) (FIG. 24). Fixation of the cap (15) to the body (1) is done by the bolt (18), which passes through the opening in the top surface of the cap (15) and is wrapped into the rack (17). Each cap (15) contains on its upper surface the opening provided with the nozzle (19), through which electric wires (20) of power supply pass from leads (7) of the electrodes (6) (FIG. 25). The wires (20) may be fixed in the nozzle, e.g., sealed with sealant or compound, or corked. The presence of caps (15) allows protecting the electrode leads of the short circuit, pollution, flooding with water or other working fluids, etc. Moreover, caps (15) allow fixing the wires (20) to prevent displacement and their breaking off, particularly in the case of constant mechanical loads of vibration type. Each wire (20) is connected to the lead (7) of the electrode 6 via the terminal (28).

Figure 20:
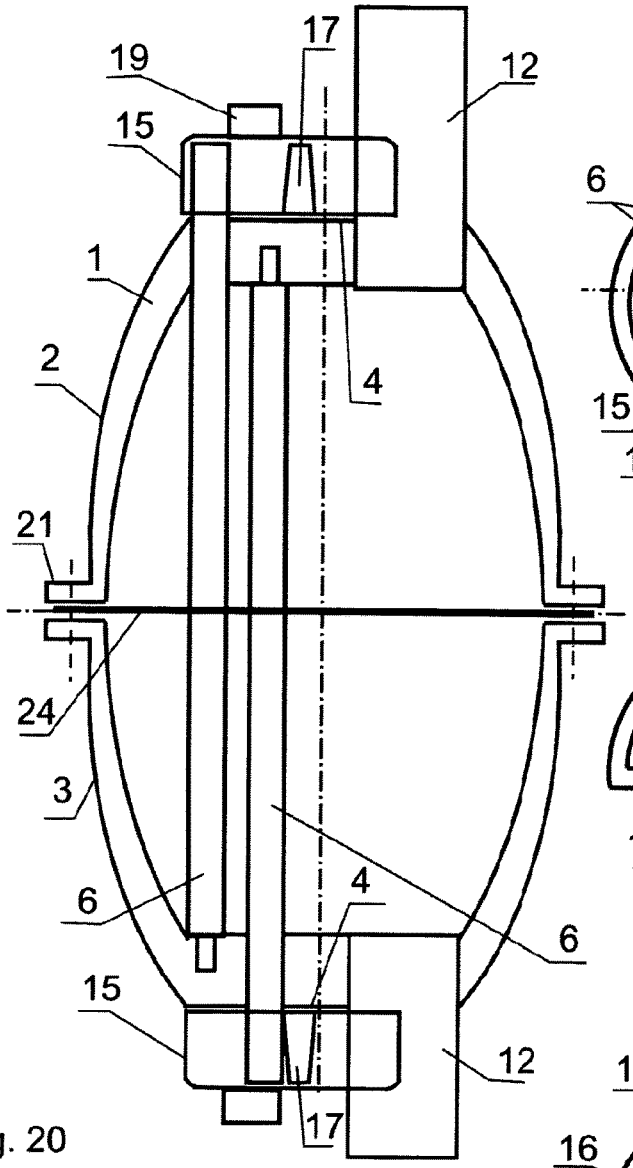
Figure 22:
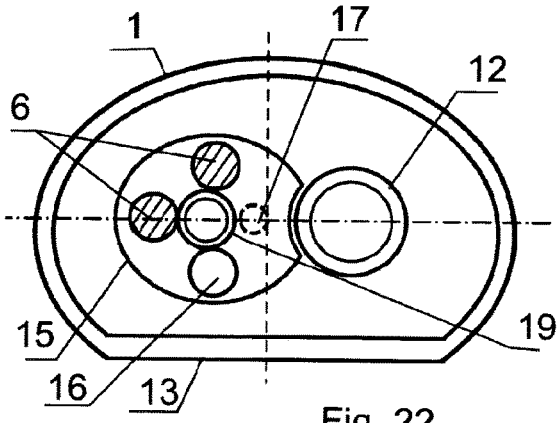
Figure 23:
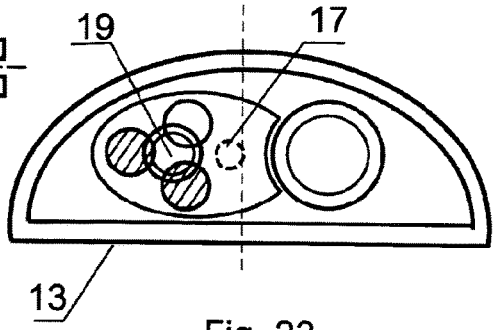
Figure 27:
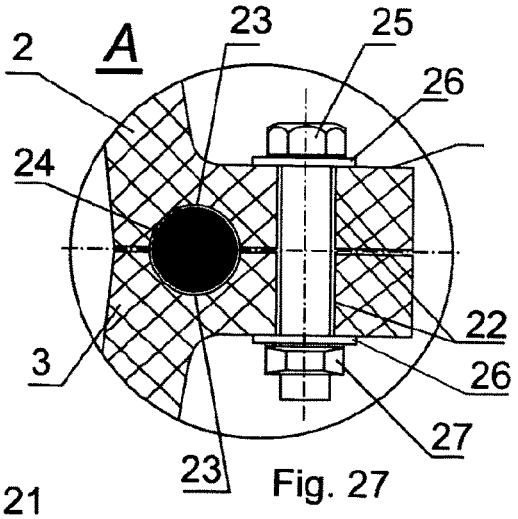

Both halves (2) and (3) of the body at the place of connection with each other have the flange (21) (FIG. 20, 25, 26, 27) located on the perimeter of the lower cut of the half of the body (1). When connecting the halves (2) and (3) to each other, the surfaces of flanges (21) of the halves (2) and (3) touch each other with matching the openings (22) in the flanges. In the slot (23) made in the flange of each half on the perimeter of the body (1) from the side of contiguous surfaces of flanges it is inserted the annular rubber gasket (24), for example, round in cross section (FIG. 27). Through holes (22) in the flanges (21) the bolts (25) pass, which with washers (26) and nuts (27) tighten the flanges (21) of the halves (2) and (3), and the rubber gasket (24) securely seals the body (1) (FIG. 20, 25).

Operation of the plastic hot water boiler in all variants is as follows.

The boiler can be used independently as pourable boiler, or it can be built in the open or circulating water heating system in any desired location, using nozzles (12). The heating system is filled with water, treated in a usual manner, adjusting its resistance and connecting leads (7) of electrodes (6) of the boiler via wires (20) located outside the body (1) and outputted through the nozzles (19) of protective caps (15). Wire connection is performed to the external electric circuit, single-phase or three-phase. Chilled water from heating radiators enters the body (1) of the boiler via the inlet nozzle (12), where it is heated by current passing through it between the electrodes (6). The heated water comes from the body (1) to consumers, such as heating radiators. Convective processes occurring in the body (1) of the boiler, when heating water between the electrodes (1), can be intentionally arranged by the proposed form of the body (1), the number of the electrodes (6), their mutual orientation and position in such a way that the boiler can serve as a circulating pump without any forced circulation of water in a closed system. The proposed possibility of the body material modification without changing its chemical properties considerably facilitates it, allowing selecting the optimal coefficients of linear and volumetric expansion, electrical resistivity and dielectric strength to be consistent with other elements of the boiler, both in static and dynamic modes of its operation.

REFERENCES

1. Manas Chanda, Salil K. Roy Plastics Technology Handbook, Fourth Edition (Series: Plastics Engineering. Book 72). CRC Press; 4 edition. 2006. 896 pages. ISBN-13: 978-0849370397.

The invention claimed is:

1. A plastic hot water boiler, comprising:

a body, the body made of heat-resistant plastic;

wherein a composition of plastic of the body includes stable isotopes of an element composing the plastic;

at least two electrodes mounted inside the body;

wherein each electrode has an electric lead;

wherein the electric lead is located on one end of each electrode, and electric leads of the electrodes are placed outside of the body;

wherein the electrodes along with leads are replaceable;

wherein connection of the electrode with electrical lead is detachable, and each electrode is configured to connect to the electric lead at any end of the electrode, wherein the body has through inlet and outlet nozzles, wherein the body is made of plastic with a predetermined coefficient of thermal expansion, and the predetermined coefficient corresponds to a coefficient of thermal expansion of electrodes, and the body has at least one flat face, the flat face pass through a symmetry axis of a cross section of the body, two caps are installed on an upper and a lower part of the body; the caps are mounted over the leads of the electrodes, each cap of the two caps is fixed to an upper or lower surface of the body via at least one rack formed as a boss, a fixation of the each cap of the two caps to the body is done by a bolt, which passes through an opening in a top surface of the cap and is wrapped into the rack, the each cap contains, on an upper surface of the each cap, an opening provided with a cap nozzle, through which electric wires pass from leads of the electrodes, water filled inside the body above is heated by current through the electrodes.

2. The plastic hot water boiler according to claim 1, where the body has:

at least one opening to fill the boiler; and at least one lid covering the filler opening of the boiler.

3. The plastic hot water boiler according to claim 1, where the body is made in the form of two detachable halves, and the halves are identical.

4. The plastic hot water boiler according to claim 1, wherein the inlet nozzle is made on a first body half, the outlet nozzle is made on a second body half, and nozzle connections with the first and the second body halves are made identical.

5. The plastic hot water boiler according to claim 1, wherein the body has an elliptical cross-section.

6. The plastic hot water boiler according to claim 1, wherein the body has an elliptical form in at least a region.

7. The plastic hot water boiler according to claim 1, further comprising:

at least two protective housings of electrodes, each of them comprises the housing body, at least one fastening element to the boiler body, holes for fastening elements, an outlet opening for wires, provided with a protective nozzle;

wherein each housing is located on corresponding half of the boiler body over the outer electric leads of electrodes, the fastening element of housing is connected to the housing and to the boiler body, housings, fastening elements to the body of the boiler are identical for the two halves of the boiler body, and the housings are integral with plastic nozzles.

8. The plastic hot water boiler according to claim 3, wherein electrode mountings are made in different body halve, and electrode mountings are made identical in different housing halves.

9. The plastic hot water boiler according to claim 3, wherein the body is made in an ellipse form in the cross-section with removed segment.

10. The plastic hot water boiler according to claim 3, wherein the body contains additional cover plate, which is made in the form of parallelepiped, is located outside of the body, one facet of the cover plate adjacent to the body has curved form corresponding to the shape of the outer part of the body, one facet of the cover plate opposite to the facet, adjacent to the body, is flat and the cover plate contains holes made from the side of the flat facet, opposite to the curved facet.

* * * * *